US006036549A

United States Patent [19]

Wulff

[11] Patent Number: 6,036,549

[45] Date of Patent: Mar. 14, 2000

[54] PLUG-IN CONNECTOR WITH CONTACT SURFACE PROTECTION IN THE PLUG-IN OPENING AREA

[75] Inventor: W.-Peter Wulff, Upton, Mass.

[73] Assignee: Siemens Aktiengesellschaft, Munich, Germany

[21] Appl. No.: 09/171,651

[22] PCT Filed: Apr. 15, 1997

[86] PCT No.: PCT/DE97/00756

§ 371 Date: Oct. 22, 1998

§ 102(e) Date: Oct. 22, 1998

[87] PCT Pub. No.: WO97/40551

PCT Pub. Date: Oct. 30, 1997

[30] Foreign Application Priority Data

Apr. 22, 1996 [DE] Germany ..... 196 15 978

[51] Int. Cl.[7] ..... H01R 23/00

[52] U.S. Cl. ..... 439/660; 439/924.1; 439/722; 439/736

[58] Field of Search ..... 439/660, 924.1, 439/79, 218, 722, 736

[56] References Cited

U.S. PATENT DOCUMENTS

| | | | |
|---|---|---|---|
| 5,169,330 | 12/1992 | Adlon et al. | 439/218 |
| 5,221,212 | 6/1993 | Davis | 439/108 |
| 5,330,372 | 7/1994 | Pope et al. | 439/692 |
| 5,766,025 | 6/1998 | Davis | 439/660 |
| 5,785,557 | 7/1998 | Davis | 439/660 |

FOREIGN PATENT DOCUMENTS

| | | |
|---|---|---|
| 2 618 614 | 1/1989 | France . |
| 34 43 888 | 5/1986 | Germany . |

*Primary Examiner*—Paula Bradley
*Assistant Examiner*—Tho D. Ta
*Attorney, Agent, or Firm*—Hill & Simpson

[57] ABSTRACT

An insulation body has an upper surface with a plurality of electric contact tracks, which lie alongside one another in one plane and run in the plug-in direction. For the purpose of contact area protection, the plug-in end of each of the contact tracks is designed as a curved sliding face or surface for the associated contact spring, and the insulation body is designed at its plug-in end with a step-shaped offset with the transition between the levels in the region of the contact tracks being designed to match the curved sliding face of the contact track and to form a rounded step.

2 Claims, 2 Drawing Sheets

PLUG-IN CONNECTOR WITH CONTACT SURFACE PROTECTION IN THE PLUG-IN OPENING AREA

BACKGROUND OF THE INVENTION

The invention relates to a plug connector having an insulation body which has an essentially rectangular cross-section. The body has an upper side with a plurality of electric contact tracks which are arranged to lie alongside one another in one plane, to run in the plug-in direction and, when the plug connector is joined to a mating connector, to cooperate with the corresponding contact springs of the connector, which springs lie alongside one another, and produce an electric contact.

Plug connectors of this type are known, and are of interest, in particular in conjunction with the standardized USB (Universal Serial Bus) design which is the aim of several computer manufacturers. Rather than, as has hitherto been the case, peripheral devices being connected to a PC via individual, parallel connections using separate, and often different, plug connector systems, this new bus system makes it possible for the peripheral devices to be connected, essentially in series, to a common bus line, which is connected directly to a printed circuit board (motherboard) of the PC via a standardized socket on the housing of the PC. The plug-in appearance of the printed circuit board socket or receptacle is essentially already defined by a specification and has four strip-like contact springs which lie alongside one another in one plane and, when the bus connector or plug is plugged in, cooperate with the four contact rails or tracks lying alongside one another in the plug and produce the electric contact. The contact springs are arranged in the socket connector in an insulation body which is essentially designed as a plastic tongue with a rectangular cross-section, and the spring are bent over in their rear region to form connecting legs which project downwards and can be plugged into contact holes in the printed circuit board. Connector and mating connector are normally provided with a metallic screening shroud or housing. Two latching hooks are provided in the top and bottom region of this shroud and the two latching hooks engage in recesses on the screening housing of the matching mating connector and produce the earthing or grounding contact and the retaining forces when the plug is pulled out.

It is generally the case with plug connectors that the contact elements of the two components to be plugged together move towards one another in the plug-in direction during the plugging-in-operation and move away from one another along the plug-in direction during the drawing-apart operation. Outside the end position, the contact elements may move either with or without contact with one another. In this arrangement, it is fundamentally desirable to prevent the contact areas from being exposed to possible damage or contamination. In the case of the plug connector known from the specification, recesses for the contact tracks, in which the latter are retained, are provided in the insulation body. Each recess forms a closed front on the plug-in side, and the recesses are open towards the upper side. In the case of this conventional plug connector design, it is unavoidable that the contact springs of the socket connector are initially moved over the front region of the insulation body of the plug when being plugged in. This presents the risk of non-conducting plastic material coming into contact with the contact areas and accelerating the wear or abrasion gold abrasion of the high-quality-plated contact areas, which are gold plated. This can increase the contact resistance at the interfaces of the plug connector system to such an extent that the signal transmission is impaired. Sharp-edged contact of the contact elements can also lead to undesirable abrasion of the gold coating.

SUMMARY OF THE INVENTION

The present invention is based on the object of solving the contact-making problems outlined above.

In the case of a plug connector of the type mentioned at the beginning, this object is achieved in that the plug-in end of each of the contact tracks is in each contact spring, in that the insulation body is designed at its plug-in end with a step-shaped offset with the transition between the levels, at least in each case in the region of the contact tracks, being designed to match the curved sliding faces or surfaces of the contact tracks and being a rounded step, and in that the contact tracks are fixedly arranged in the insulation body by being partially embedded in plastic.

DESCRIPTION OF THE PREFERRED EMBODIMENTS

Figure 1:
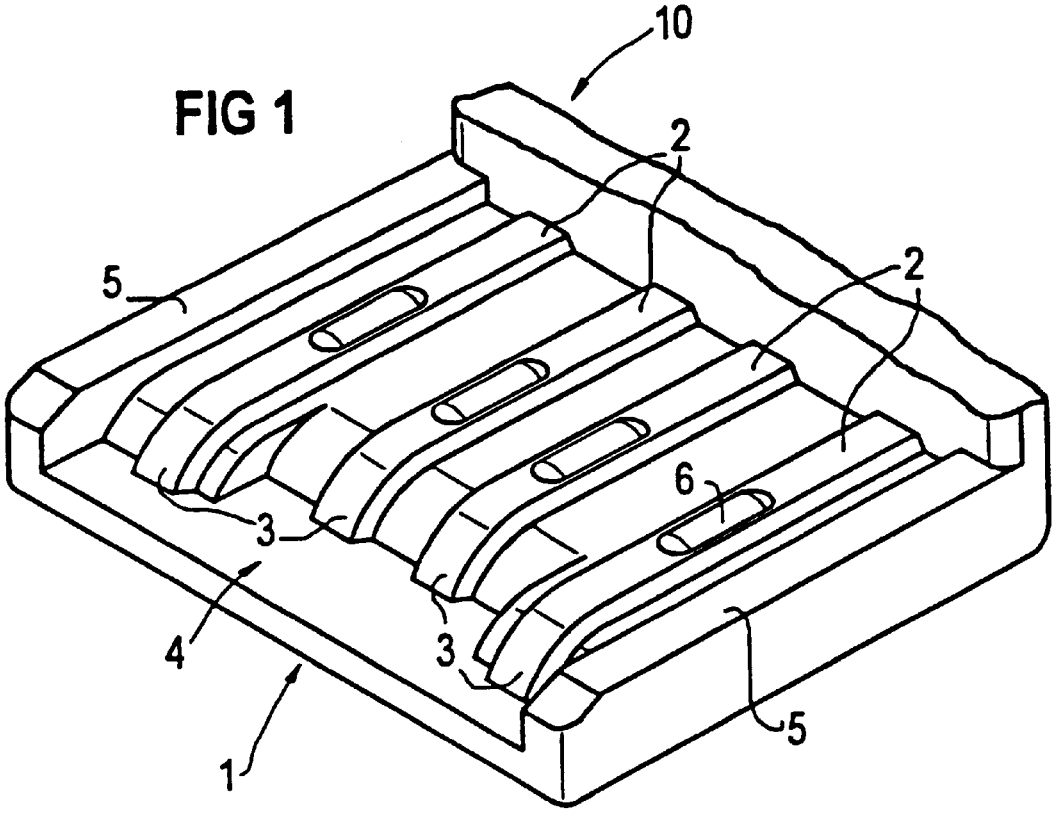
FIG. 1 is a perspective partial view of a plug connector according to the invention.

In FIG. 1, a plug connector 10 is illustrated and has an insulation body 1 which has at its plug-in end a step-shaped offset 4, so that the contact tracks 2, which are arranged at the higher level, end before the plug-in end of the insulation body 1. The body therefore forms at the plug-in end a front which is not closed but rather is designed to be open in the plug-in-opening region. The contact tracks 2 are in each case designed with a curved sliding face or surface 3. As a result of this and of the open front region of the insulation body 1, protection is offered against sharp-edged and/or abrasion-related contact with the mating connector 11 during the plugging-in operation, since, according to the invention, the normally likewise rounded contact point 7 (see FIG. 3) of the contact spring of the connector 11 now cooperates with the sliding face 3 and also no longer has to be moved over a sharp front edge of the insulation body 1. The offset 4 and the free face formed thereby accordingly have the effect that the incoming contact spring, which sags downwards somewhat, does not come into contact with the insulation body 1 prior to making contact with the sliding face 3.

In order to reduce the contact abrasion further, it is advantageous also to provide an offset of the plastic material at the sides of the contact tracks 2 in each case, as illustrated in FIG. 1. The insulation body 1 is thus, in principle, to be designed such that it is set back in all the areas which could interfere during plugging in.

Figure 3:
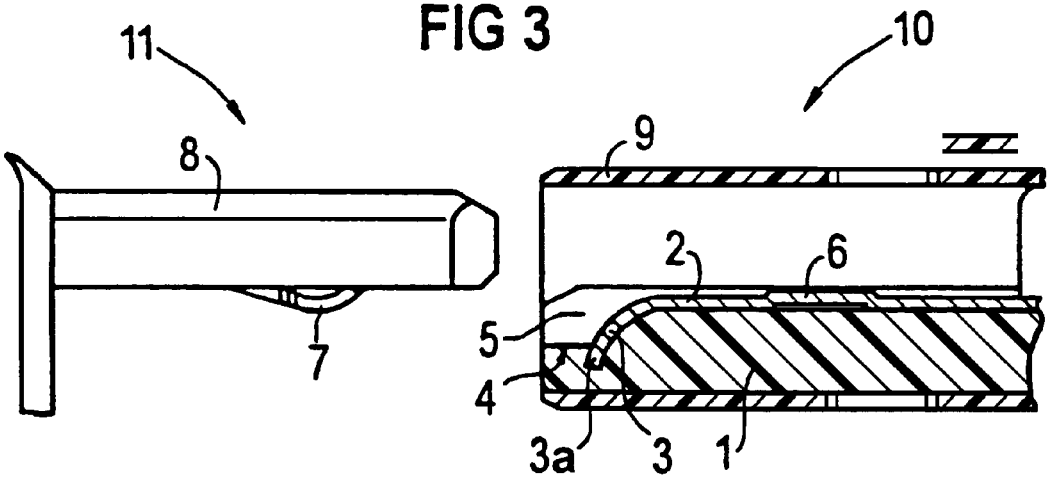
FIG. 3 is a schematic view with portions broken away of the plug connector and of a corresponding mating connector in the unplugged state.

As can be seen in FIG. 1, the insulation body 1 is designed with side edges 5 whose height is dimensioned such that the plastic tongue 8 (see FIG. 3) of the mating connector 11 slides over these side edges 5 exactly at the envisaged height when being plugged in, with the result that the contact elements 3, 7 of the socket and plug come into contact with one another as envisaged. The further setting back of the two central contact tracks in relation to the outer contact tracks is based on the fact that the outer contact tracks are normally used as power connections and are intended to form a contact at a point in time before the inner signal contacts. In the end position, the rounded-off contact points 7 are in contact with offset contact regions 6, which are arranged approximately in the centre of the contact tracks 2. As a result of partially embedding the contact tracks in plastic, these are held precisely in position and cannot lift off from the insulation body 1, which is of importance in particular with regard to the curved sliding face 3. As can be seen in FIG. 3, the tip 3*a* of the sliding face 3 is anchored in the insulation body 1 in the region of the offset 4. Partially embedding also offers the advantage that an additional mounting procedure (insertion of the contact tracks) is not necessary.

Figure 2:
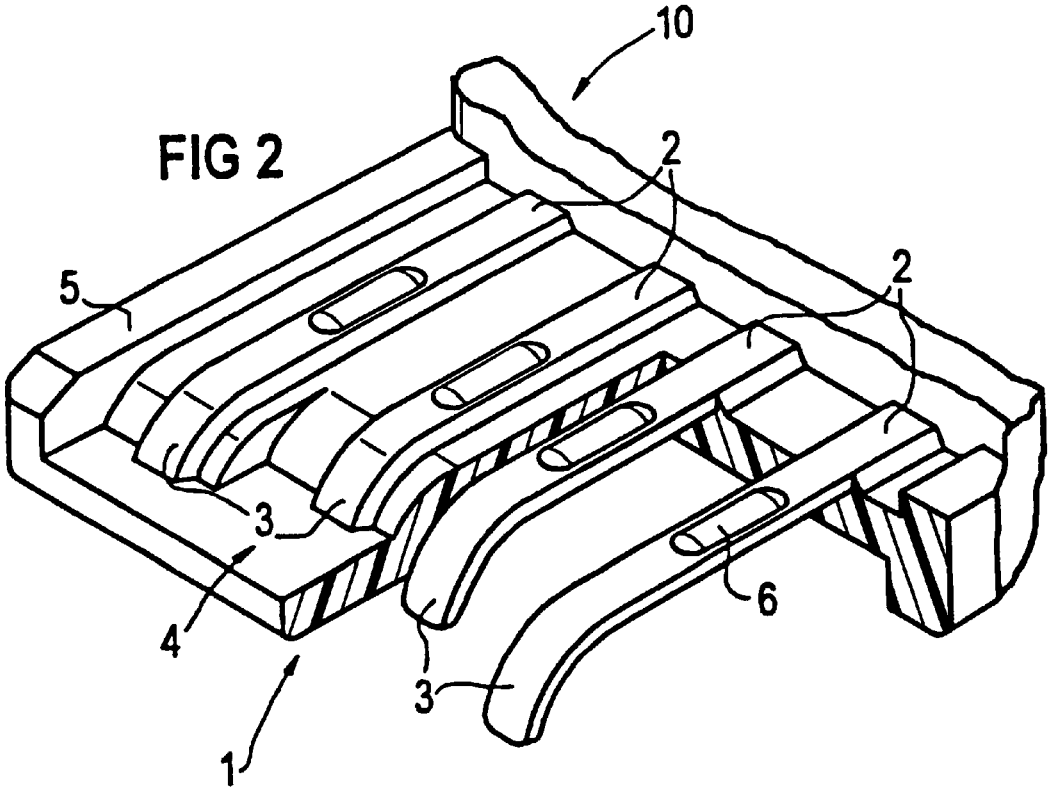
FIG. 2 is a partly sectioned view of the plug connector according to FIG. 1.

In FIG. 2, for better understanding, the two right-hand contact tracks 2 are illustrated in an (imaginary) non-encased state. In FIGS. 1 and 2, for simplicity, only the plug-in region of the plug connector 10 is illustrated. The plastic tongue 8 and the contact point 7 of the contact spring, which sags downwards somewhat, of the mating connector 11 can be seen in FIG. 3. The plug connector 10 according to the invention is illustrated here with a shroud 9. In the plugged-in state, the plastic tongue 8 lies above the insulation body 1.

I claim:

1. A plug connector having an insulation body which has essentially a rectangular cross-section and on an upper surface of the body has a plurality of electrical contact tracks which lie alongside one another in one plane and extend in a plug-in direction toward a plug-in end of the body, each of said contact tracks cooperating with a corresponding contact spring of a mating connector, which contact springs lie alongside one another to form an electrical contact, the improvements comprising a plug-in end of each of the contact tracks having a curved sliding surface for the corresponding contact spring, the insulation body at the plug-in end having a step-shaped offset with a transition between a lower level at the plug-in end and a second level of the one plane in the region of the contact tracks to match the curved sliding surface of the contact tracks to form a rounded step, and the contact tracks being partially embedded in the plastic of the insulation body with a tip of the curved sliding surface being embedded in said body so that each contact track is fixedly mounted on said upper surface of the insulation body.

2. A plug connector according to claim 1, wherein an outer contact track on each side of the insulating body extends farther in the plug-in direction than the remaining contact tracks so that the curved sliding surfaces of the remaining contact tracks are inwardly offset from the sliding surfaces of the outer contact tracks.

* * * * *